US008042274B2

(12) United States Patent
Lau et al.

(10) Patent No.: US 8,042,274 B2
(45) Date of Patent: Oct. 25, 2011

(54) MULTIFUNCTION SCISSOR

(76) Inventors: Kevin Kin-wai Lau, San Diego, CA (US); Ji Hoon Lee, San Diego, CA (US)

( * ) Notice: Subject to any disclaimer, the term of this patent is extended or adjusted under 35 U.S.C. 154(b) by 325 days.

(21) Appl. No.: 12/290,294

(22) Filed: Oct. 28, 2008

(65) Prior Publication Data

US 2009/0193666 A1 Aug. 6, 2009

Related U.S. Application Data

(60) Provisional application No. 61/063,070, filed on Jan. 31, 2008.

(51) Int. Cl.
*B26B 13/00* (2006.01)

(52) U.S. Cl. ..... 30/123; 30/254; 30/257

(58) Field of Classification Search ..... 30/131, 30/136, 142, 146, 148, 254, 257; 7/113, 7/128, 131, 135; 452/1–17; D8/57; D7/693
See application file for complete search history.

(56) References Cited

U.S. PATENT DOCUMENTS

| | | | | | |
|---|---|---|---|---|---|
| 572,808 | A | * | 12/1896 | Killian | 30/146 |
| 592,945 | A | * | 11/1897 | Youngblood | 30/146 |
| D28,974 | S | * | 7/1898 | Girtanner | D8/57 |
| D32,582 | S | * | 4/1900 | Mitchell | D8/57 |
| 739,643 | A | * | 9/1903 | Bolsinger | 30/120 |
| 834,601 | A | * | 10/1906 | Woernle | 30/142 |
| 1,230,766 | A | * | 6/1917 | Ovens | 30/148 |
| D77,223 | S | * | 12/1928 | Ern | 30/341 |
| 2,038,916 | A | * | 4/1936 | Vorwerk | 7/135 |
| D104,727 | S | * | 6/1937 | Rauh | D8/57 |
| D118,280 | S | * | 12/1939 | Hausmann | D8/57 |
| D123,079 | S | * | 10/1940 | De Requesens | D8/57 |
| D171,837 | S | * | 3/1954 | Blanchaert | D8/57 |
| D196,381 | S | * | 9/1963 | Basilotta | 452/17 |
| D236,248 | S | * | 8/1975 | Wolff | D8/57 |
| 4,132,502 | A | * | 1/1979 | Bunke | 7/113 |
| D258,560 | S | * | 3/1981 | Stout | D8/57 |
| 4,315,369 | A | * | 2/1982 | Borow | 30/257 |
| 4,463,495 | A | * | 8/1984 | Johnson et al. | 30/142 |
| 4,519,136 | A | * | 5/1985 | Walker | 30/142 |
| 4,521,964 | A | * | 6/1985 | Maruyama | 30/148 |
| D285,166 | S | * | 8/1986 | Lee | D8/57 |
| D310,469 | S | * | 9/1990 | Dressler | D8/57 |
| D333,416 | S | * | 2/1993 | Brown, Jr. | D8/57 |
| 5,517,761 | A | * | 5/1996 | Wang | 30/254 |
| D382,785 | S | * | 8/1997 | Kobayashi et al. | D8/57 |
| D384,260 | S | * | 9/1997 | Dunch | D8/57 |
| 5,724,688 | A | * | 3/1998 | Chen | 7/128 |
| D403,569 | S | * | 1/1999 | Frazer | D8/57 |
| 5,970,615 | A | * | 10/1999 | Wall | D8/57 |
| 6,129,622 | A | * | 10/2000 | Seaman et al. | 452/6 |
| 6,158,128 | A | * | 12/2000 | Huff | 30/254 |
| D437,197 | S | * | 2/2001 | Ohno | D8/57 |
| 6,289,768 | B1 | * | 9/2001 | Anderson et al. | 7/128 |
| D460,334 | S | * | 7/2002 | Carpenter et al. | D8/57 |

(Continued)

FOREIGN PATENT DOCUMENTS

JP 04053582 A * 2/1992

*Primary Examiner* — Jason Daniel Prone

(57) ABSTRACT

A multifunction scissor configured for cutting and scraping for use in, for example, eating shellfish. The multifunction scissor can include an extension that function as a scraper. The multifunction scissor also can be configured such that the blade tips form a fork.

11 Claims, 5 Drawing Sheets

U.S. PATENT DOCUMENTS 6,450,071 B2 * 9/2002 Berg et al. ..... 7/128
7,112,129 B2 * 9/2006 Zimbone et al. ..... 452/6
7,117,873 B2 * 10/2006 Bachrach et al. ..... 132/148
D594,723 S * 6/2009 Kim ..... D8/57
D613,141 S * 4/2010 Wang ..... D8/57
2006/0027064 A1 * 2/2006 Panik et al. ..... 30/322

* cited by examiner

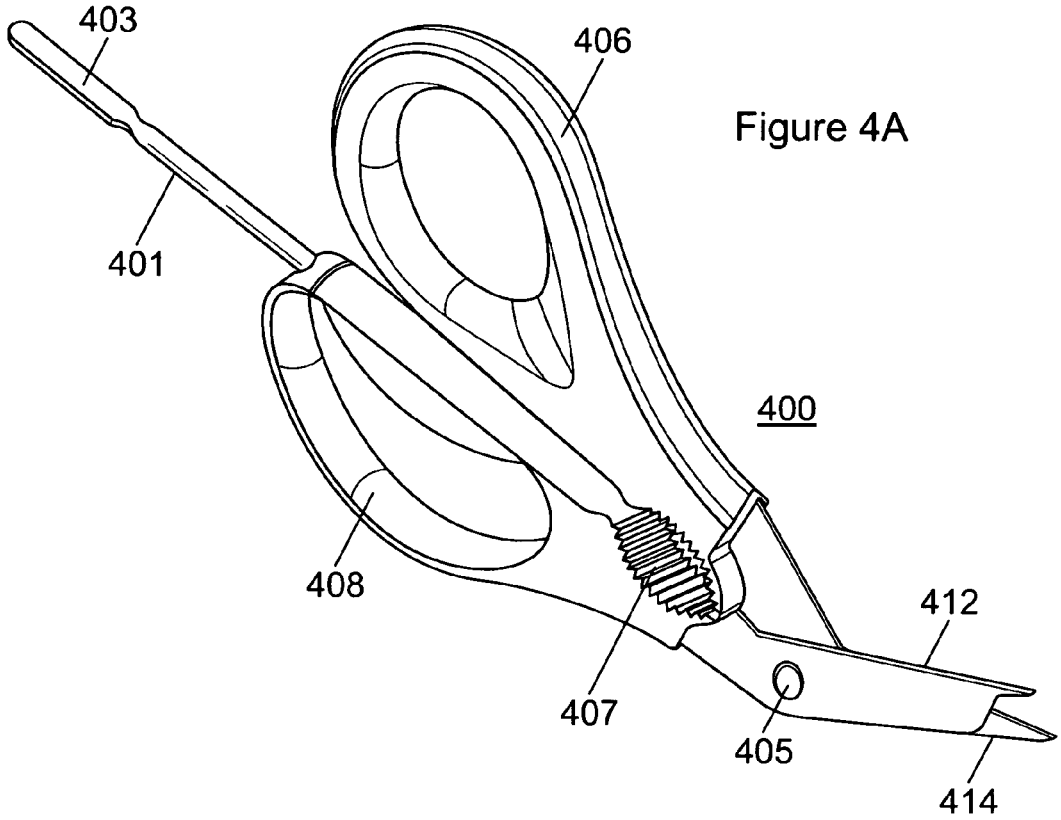
Figure 4A
Figure 4B
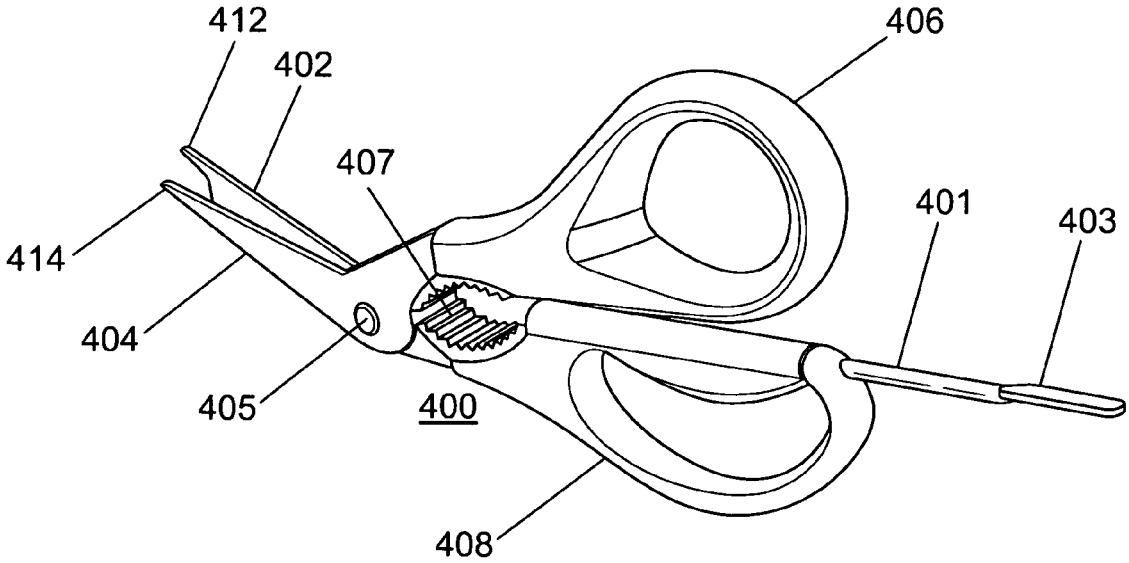

MULTIFUNCTION SCISSOR

CROSS-REFERENCE TO RELATED APPLICATIONS

This application claims the benefit of the U.S. provisional application Ser. No. 61/063,070 filed on Jan. 31, 2008 under 35 USC 119(e), the entire contents of which are incorporated by reference.

SUMMARY OF THE INVENTION

Eating shellfish, such as lobster or crab, can be difficult, time consuming, and messy. A hammer, knife and/or nutcracker have been used to crack the shell of a shellfish. Pieces of the shell can then be separated and the meat removed. Using a hammer and/or nutcracker can crush or otherwise damage the meat, however, which can result in less edible meat being extracted. In addition, using a hammer and/or nutcracker can create small shell fragments that can become mixed with the meat. The present invention is a pair of scissors designed for cutting and extracting meat from shellfish.

DESCRIPTION OF THE DRAWINGS

FIGS. 4A and 4B show an example of a multifunction scissor.

DETAILED DESCRIPTION

A simple approach to using scissors for shellfish, such as crab legs, includes cutting along the shell on opposing sides and then pulling the two halves apart to reveal the meat in between. However, traditional scissors are unsuitable for this purpose.

Figure 1:
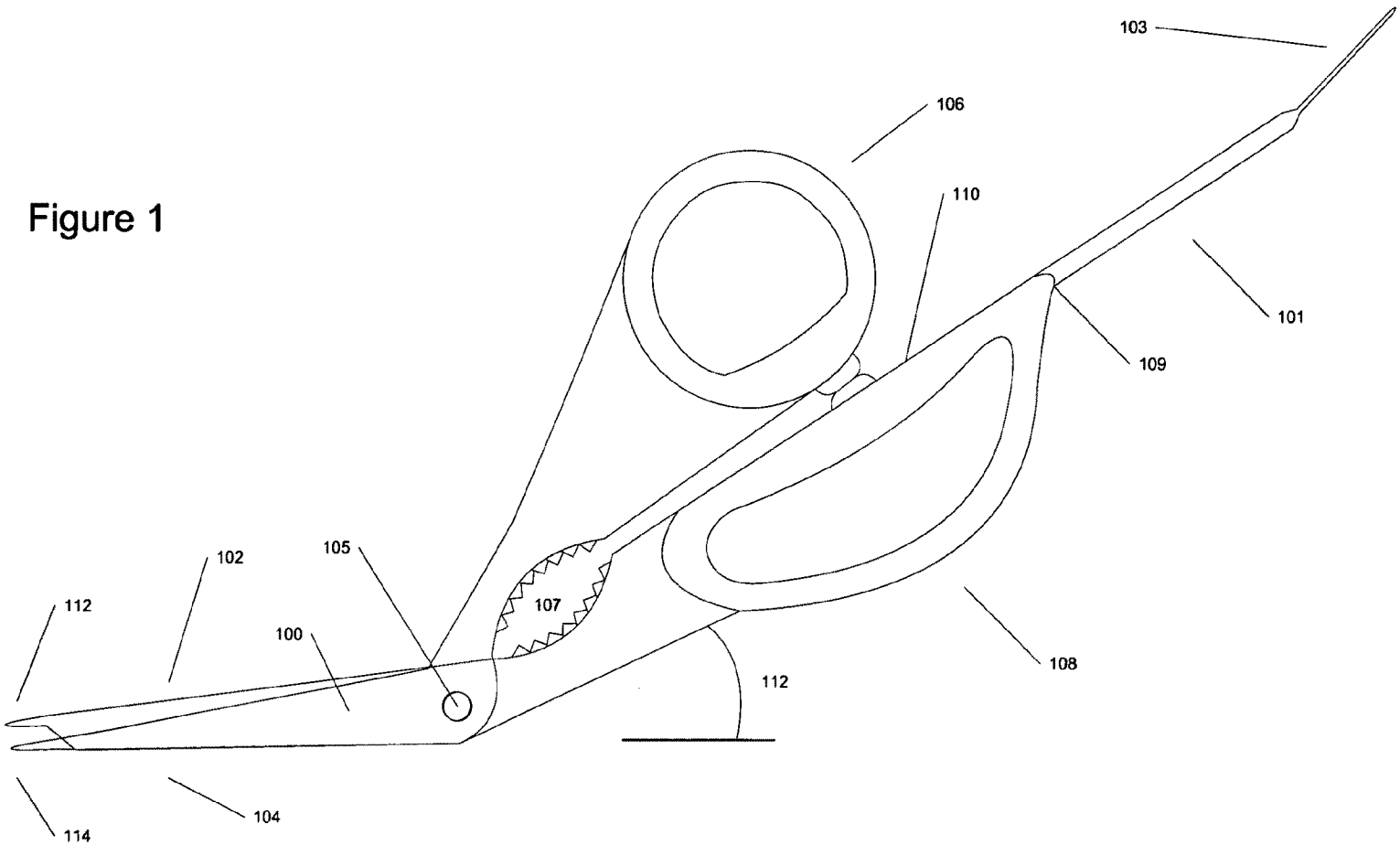
FIG. 1 shows an example of a multifunction scissor in a closed position.

FIG. 1 shows an example of a multifunction scissor 100 in a closed position including an extension 101. The multifunction scissor includes a pair of scissor blades (102 and 104) at one end and a pair of grips (106 and 108) forming a handle at the other end of the multifunction scissor. The top grip 106 is connected with the bottom blade 104 forming a first lever while the bottom grip 108 is connected with the top blade 102 forming a second lever. A pivot 105 connects the first and second levers.

The bottom blade 104 may be shorter than the top blade 102. The height of bottom scissor blade 104 of the multifunction scissor should be minimal so that it can be more easily fitted under or into small areas, such as a crab leg. For example, the maximum height of blade 104 may be approximately 1 cm or ½ in.

Figure 2:
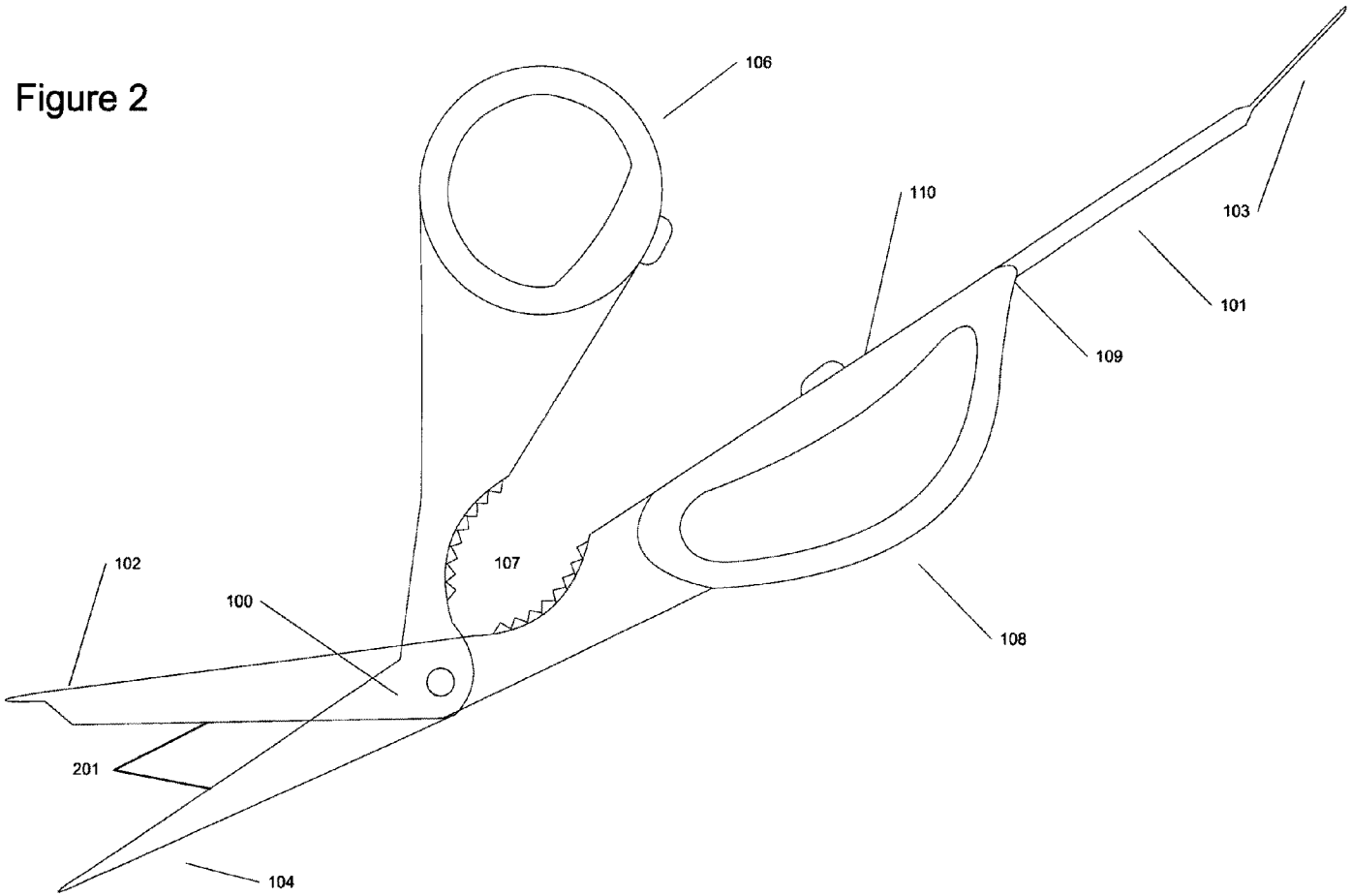
FIG. 2 shows an example of a multifunction scissor in an open position.

FIG. 2 shows an example of a multifunction scissor 100 in an open position. FIG. 2 also illustrates the cutting edges 201 of the multifunction scissor where the two scissor blades cross during use.

The multifunction scissor can be configured to increase the degree of force that can be placed on an object, such as a shellfish shell, during cutting. An example of such a configuration would place the grips 106 and 108 farther away from the pivot than the cutting surfaces 201. For example, the cutting surfaces may range between 1 and 8 cm from the pivot while the grips 106 and 108 can be placed between 6 and 20 cm away from the pivot 105. A nutcracker 107 may be positioned between the grips and the pivot.

Further, the top and bottom scissor blades 102 and 104 can be angled relative to the handle. For example, the angle 112 of the handle relative to the scissor blades 102 and 104 can be between 15 and 60 degrees. This angle allows the user to operate the handle freely without obstruction as the scissors cut forward through items such as crab legs.

For maximum strength and durability, the blades and grips would be formed from a metal, such as stainless steel and/or titanium. However, manufacturing costs may be lower using plastic or rubberized grips attached to stainless steel and/or titanium blades.

The multifunction scissor includes additional tools and functionality. For example, two possible additions are a scraper and a fork/forceps as described below.

Scraper

FIG. 1 shows an example of an extension 101 to grip 108 of a pair of scissors. The extension 101 functions as a scraper. The extension is long and thin to encourage its use as a scraper and may be, for example, between 2" to 6" long. The scraper may also be used to extract shellfish meat by pushing meat through a joint.

In addition, the end of the extension 101 may be flat or concave on at least one surface to facilitate its use as a scraper. The exemplary scraper 103 is 1" long and flat on both the top and bottom surfaces. As a scraper, the extension may be used, for example, to scrape meat off the side of shells or to pull meat out of joints of shellfish such as crab. The scraper 103 may also be angled slightly with respect to the extension 101 with a concave surface so that it may function as a small, narrow spoon or scooper. Further, when used to scrape against concave surfaces, such as those found on the inside of crab legs, the tip of scraper 103 may be rounded.

The multifunction scissor may include a handle designed so that the scissors can be handled backward (i.e., with the closed blades facing the elbow and the scraper facing forward away from the elbow). In this design, the scraper can be used as a straight extension pointing away from the user. Additionally, a locking mechanism, such as a simple clip or hook, would be useful to prevent the scissor from accidentally opening and cutting the user.

Fork/Forceps

FIGS. 1 and 2 show an example of a new blade design. The new blade design incorporates a fork at the scissor tip. The fork is composed of at least 2 tines where one tine 112 is attached to the top blade 102 while another tine 114 is attached to the bottom blade 104. This new blade design allows the scissor tips, which are frequently not used when cutting, to also function as the tines of a fork when the scissors are in the closed (or nearly closed) position as shown by FIG. 1. The tines are also known as prongs.

Figure 3:
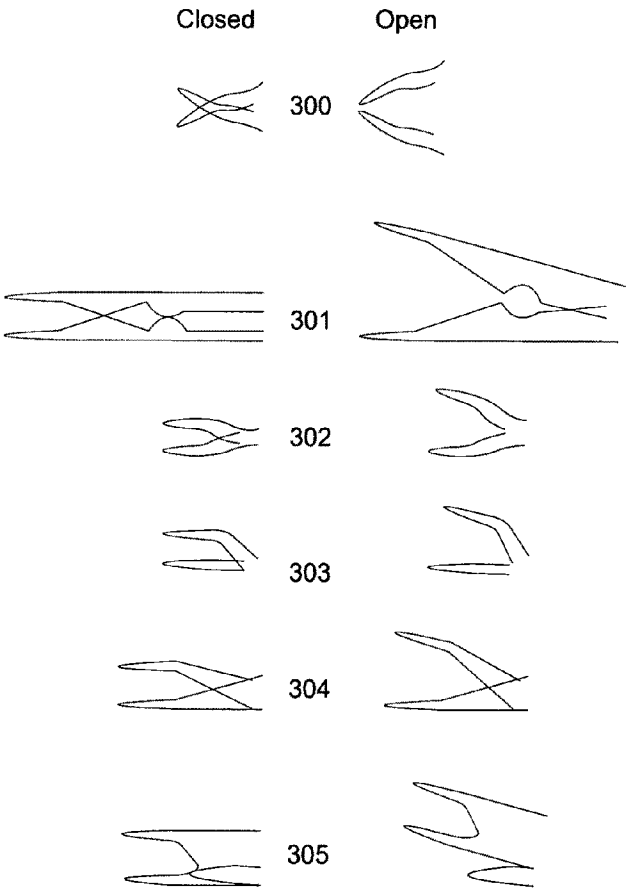
FIG. 3 shows an example of prongs that can be formed at the tips of the multifunction scissor.

An alternative blade design 300 (shown in FIG. 3) includes a curve in the tines such that they point towards each other. Specifically, the top tine curves downward while the bottom tine curves upward. This design allows the scissor tips to function as a fork in a nearly closed position but also as a pair of forceps. The forceps is useful for items, such as crab shell fragments, which cannot be picked up with a fork.

In addition, the curved blade tips 300 are also useful for removing sharp spikes from the shell of crabs that would normally prevent a secure grip and/or hurt the hands. Together, the curved blade tips remove the sharp spikes by wrapping around the spike without slipping out from between the scissor blades. The curved blade tips may also be advantageous for removing the tip of a crab claw or other similarly sharp appendages. The removal of the tip provides access to the end of the crab claw for inserting the scraper or for using the scissors to cut open the crab claw. The spike remover may also be implemented using straight fork tines with concave edges in the scissor blades as shown by 301. The concave blade edges may also be useful for more cleanly cutting tubular or rounded items, such as straws or flower stems, which would normally be pushed forward in a scissor with straight blades.

Additional blade tip designs are depicted in their open and closed positions 302, 303 and 304. It is obvious to one of ordinary skill in the art that many potential blade tip designs for forming a fork with and without additional functionality are contemplated in the current invention. Furthermore, the top (or bottom) blade may incorporate both tines of a fork as shown by 305. The blade tip design 305 allows the scissor to cut materials with small openings while also retaining the forked design of the present invention. In the blade tip design 305, the blade without tines can be made shorter than the blade with tines to prevent a fork tine from being used as a cutting edge. The blade without tines can also be made wider than a fork tine, perhaps even as wide as the blade with tines, to strengthen the blade for cutting hard materials (not shown).

FIGS. 4A and 4B show an example of a multifunction scissor 400 including both a scraper and a fork. The exemplary scraper 403 is connected to extension 401 which is connected to a contoured finger grip 408. Scissor 400 also includes a fork composed of two tines 412 and 414. Tine 412 is connected with the top blade 402 which is connected with the bottom grip 408. Tine 414 is connected with the bottom blade 404 which is connected to top grip 406. The top grip 406 is a contoured thumb grip. A cracker 407 is positioned between the grips and the pivot 405.

Other Improvements

The multifunction scissors may also include a pair of opposing serrated (or otherwise textured) concave edges 107 similar to those frequently found on nutcrackers. These opposing concave edges are useful for cracking the shell of shellfish or as a tool for gripping a portion of the shellfish.

The multifunction scissors may also include non-slip, textured or rubberized handle grips. Various grips may be preferable based on the intended use of the scissors. For example, these grips are preferable when the scissors may be used in messy environments, such as when eating shellfish.

The multifunction scissors may also include other improvements such as bottle openers, different handle grips, decorative aspects, locking mechanisms, and spring loading (to automatically open the scissors). The extension from the lower grip may also be designed to include other functionality. For example, the extension may be designed to function as the blade of a knife, an oyster knife, a small spoon, a small fork, a small spork (combination fork and spoon), or other combination utensil.

Figure 5:
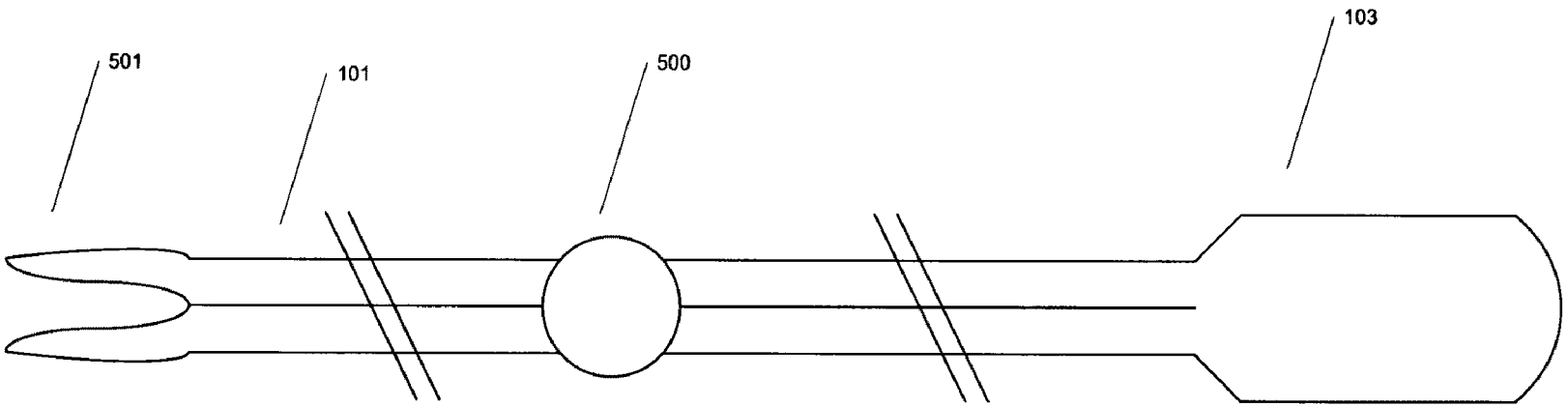
FIG. 5 shows an example of a detachable seafood doohickey extension.

The extension 101 and scraper 103 may also be a part of a detachable seafood doohickey as shown in FIG. 5. The detachable seafood doohickey may also include a detent 500 and a seafood fork 501 or awl (not shown). The extension may be hexagonal or otherwise shaped to prevent it from rotating while attached to the multifunction scissor. The detent 500 may be a ball detent or other equivalent mechanism to prevent the detachable seafood doohickey from accidentally detaching from the multifunction scissor. A separate detent 500 may not be necessary if the grip and extension are designed to prevent accidental release.

In one potential design, the end of grip 108 may include a hole or other opening for holding the extension at 109. The detachable extension would be designed to fit snugly inside of the opening of grip 108. Alternatively, in another possible design, the top of grip 108 may include a depression shaped according to extension 101 for securely holding the extension at 110.

In another potential design, the blades 102 and/or 104 may be curved. This curved blade design allows the multifunction scissor to more easily cut curved objects such as shrimp or lobster shells.

The invention claimed is:

1. A multifunction scissor comprising:

a first lever including a first grip, a first cutting edge and a first tine;

a second lever including a second grip, a second cutting edge and a second tine;

a tool received by the first lever, wherein the tool extends rearwardly beyond the first grip and includes a grip portion, a substantially flat rectangular scraper on one end, and an at least two pronged portion on an opposite end; and a pivot point movably coupling the first and second levers such that the first tine and second tine form a fork when the first tine is positioned substantially parallel to the second tine.

2. The multifunction scissor of claim 1, wherein the tool is removably received by the first lever.

3. The multifunction scissor of claim 2, wherein the at least two pronged portion of the scraper form a second fork.

4. The multifunction scissor of claim 1, wherein the first and second tines are angled toward each other.

5. The multifunction scissor of claim 1, wherein the first and second tines are curved toward each other.

6. The multifunction scissor of claim 1, wherein the first and second tines are angled away from each other.

7. The multifunction scissor of claim 1, wherein the first and second tines are curved away from each other.

8. The multifunction scissor of claim 1, wherein at least one of the first and second tines includes a concave edge.

9. A multifunction scissor comprising:

a first lever including a first grip and a first cutting edge;

a second lever including a second grip and a second cutting edge;

a tool received by the first lever, wherein the tool extends rearwardly beyond the first grip and includes a grip portion, a substantially flat rectangular scraper on one end, and an at least two pronged portion on an opposite end; and a pivot point movably coupling the first and second levers.

10. The multifunction scissor of claim 9, wherein the tool is removably received by the first lever.

11. The multifunction scissor of claim 10, wherein the at least two pronged portion of the scraper form a fork.

* * * * *